US005947845A

United States Patent [19]

Canelas

[11] Patent Number: 5,947,845

[45] Date of Patent: Sep. 7, 1999

[54] COMBINATION BALL AND SHOES

[76] Inventor: Carlos Canelas, 120 Picketts Charge #129, Ft. Thomas, Ky. 41075

[21] Appl. No.: 09/047,560

[22] Filed: Mar. 25, 1998

Related U.S. Application Data

[60] Provisional application No. 60/042,315, Apr. 15, 1997.

[51] Int. Cl.[6] ..... A63B 69/00

[52] U.S. Cl. ..... 473/446; 473/569; 273/DIG. 18

[58] Field of Search ..... 473/420, 423, 473/424, 438, 446, 471, 506, 569, 573, 576, 604, 595, 614; 434/251; 273/DIG. 18

[56] References Cited

U.S. PATENT DOCUMENTS

| | | | |
|---|---|---|---|
| 3,348,842 | 10/1967 | Stern | 473/438 |
| 3,370,851 | 2/1968 | Murray | 473/438 |
| 3,425,693 | 2/1969 | Murray | 473/438 |
| 5,290,043 | 3/1994 | Vidinic | 473/446 |
| 5,433,437 | 7/1995 | Dudley . | |
| 5,503,699 | 4/1996 | Ratner et al. | 473/614 |
| 5,555,650 | 9/1996 | Longbottom et al. . | |

OTHER PUBLICATIONS

Soccer pal, Page from Booklet (date unknown).

SoccerPal, *What Players Need to Get Started,* Pamphlet, 1997.

*Primary Examiner*—Steven Wong

*Attorney, Agent, or Firm*—Wood, Herron & Evans, L.L.P.

[57] ABSTRACT

A combination of a pair of soccer shoes and a soccer ball wherein each of the shoes and the ball have an exterior surface marked with selected areas of differing shapes and colors. The markings on the shoes correspond in shape and color to the markings on the exterior of the ball in order to instruct a user where to strike the ball with which portion of his or her foot in order to make the ball move in desired directions.

8 Claims, 4 Drawing Sheets

COMBINATION BALL AND SHOES

This application is a continuation application of Provisional Patent Application, Ser. No. 60/042,315, filed Apr. 15, 1997, entitled COMBINATION BALL AND SHOES which is incorporated by reference herein.

FIELD OF THE INVENTION

This invention relates to balls used for games such as soccer and shoes used by the players of the game to be worn during practice. The combination of the ball and shoes functions as an instructional tool.

BACKGROUND OF THE INVENTION

A typical soccer ball is either entirely white or white with black pentagons scattered across the surface of the ball. There are no individual markings on the ball other than perhaps the label of the ball manufacturer.

Similarly, shoes used to play either soccer or football are typically black with individual cleats comprising the bottom surface of the shoes. The top exterior surface of the shoe is typically uniform for both shoes and colored black with the exception of individual manufacturer's markings.

In kicking a soccer ball with a soccer shoe, it is necessary to impact different parts of the ball with different portions of the shoe in order to make the ball move in different directions and at different velocities. For example, if one desires to kick the ball low and hard, i.e. at a high velocity, one must strike the ball with the shoe laces of the shoe, otherwise known in the industry as the instep. Likewise, if one desires to make a short pass to a teammate keeping the ball on the ground, one must strike the middle of the ball with the inner side surface of the shoe.

Further, in order to make the ball curve to either the right or left when one strikes the ball with one's foot, it is desirable to strike a preselected portion of the ball with a preselected portion of the foot. For example, if a right footed kicker desires to make the ball curve from right to left, he or she may strike the exterior of the ball with the inside toe portion of the right foot. Conversely, if the right footed kicker desires to make the ball curve outwardly, i.e. from left to right, the kicker may strike the left side of the ball with the outer toe portion of his or her right foot.

Often when a young child or beginner is learning to play the game of soccer, the child learns through experimentation that if he or she strikes certain portions of the ball with certain portions of his or her foot, the ball will move in the desired direction and at the desired velocity. However, learning where on one's foot to strike the ball and at which location on the ball is a time consuming learning process and typically takes years and years. Therefore, applicant has developed a set of soccer shoes and a soccer ball which will aid in teaching soccer players and, in particular, youth or beginners to kick a soccer ball correctly in order to make the soccer ball move in desired directions and at different desired velocities.

U.S. Pat. No. 5,433,437 discloses a soccer training device which may be secured onto a soccer shoe and is activated by being impacted by the ball. When the device contacts the ball, a sound is made indicating to the user that he or she struck the ball correctly. The device may be adjusted in any of several preselected positions on the foot. However, this device must be moved from location to location on the foot by adjusting the strap around the foot in order to teach different types of kicks such as those mentioned hereinabove. Also, the user of such a training device may find it awkward to have such a device protruding outwardly from one's foot. Further, the device may not function properly if the device moves slightly while the user is running or the ball impacts the device off center slightly.

Applicant has devised a soccer ball and shoe which instructs an individual to perform different types of kicks using solely soccer shoes and a ball without the trainee having to strap on any external device to his or her shoe.

Therefore, it has been one objective of the present invention to provide a training device comprising a soccer ball and a soccer shoe which have marked areas on the exterior thereof.

It has further been an objective of the present invention to provide a soccer shoe and soccer ball which may teach an individual where on one's shoe to kick a soccer ball to make the ball move desired directions and at desired velocities.

It has further been an object of the present invention to provide a marked soccer ball and marked soccer shoes which are color coded with preselected marked areas on the soccer ball being of the same color as preselected marked areas on the shoe so as to instruct an individual where to kick the ball.

It further has been an objective of the present invention to provide a marked pair of soccer shoes and a marked soccer ball which are specifically adapted for teaching youth to kick with either their right foot or their left foot or both.

DETAILED DESCRIPTION OF THE DRAWINGS

Figure 1:
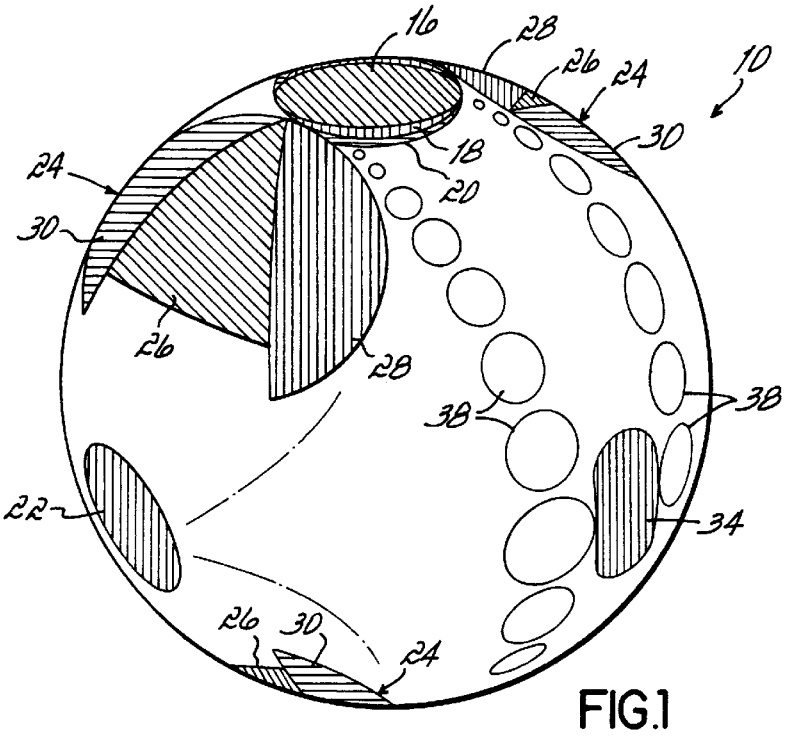
FIG. 1 is a perspective view of a soccer ball of the present invention.

Referring to the drawings, the areas illustrated with vertical markings are colored red in accordance with Patent Office rules. Likewise, the shaded areas in which the lines go from left to right at a 45° angle correspond to the color green and horizontal lines correspond to the color blue. Also, applicant has attached the letter R to several of the red colored areas, the letter G to several of the green colored areas and the letter B to several of the blue colored areas.

Figure 3:
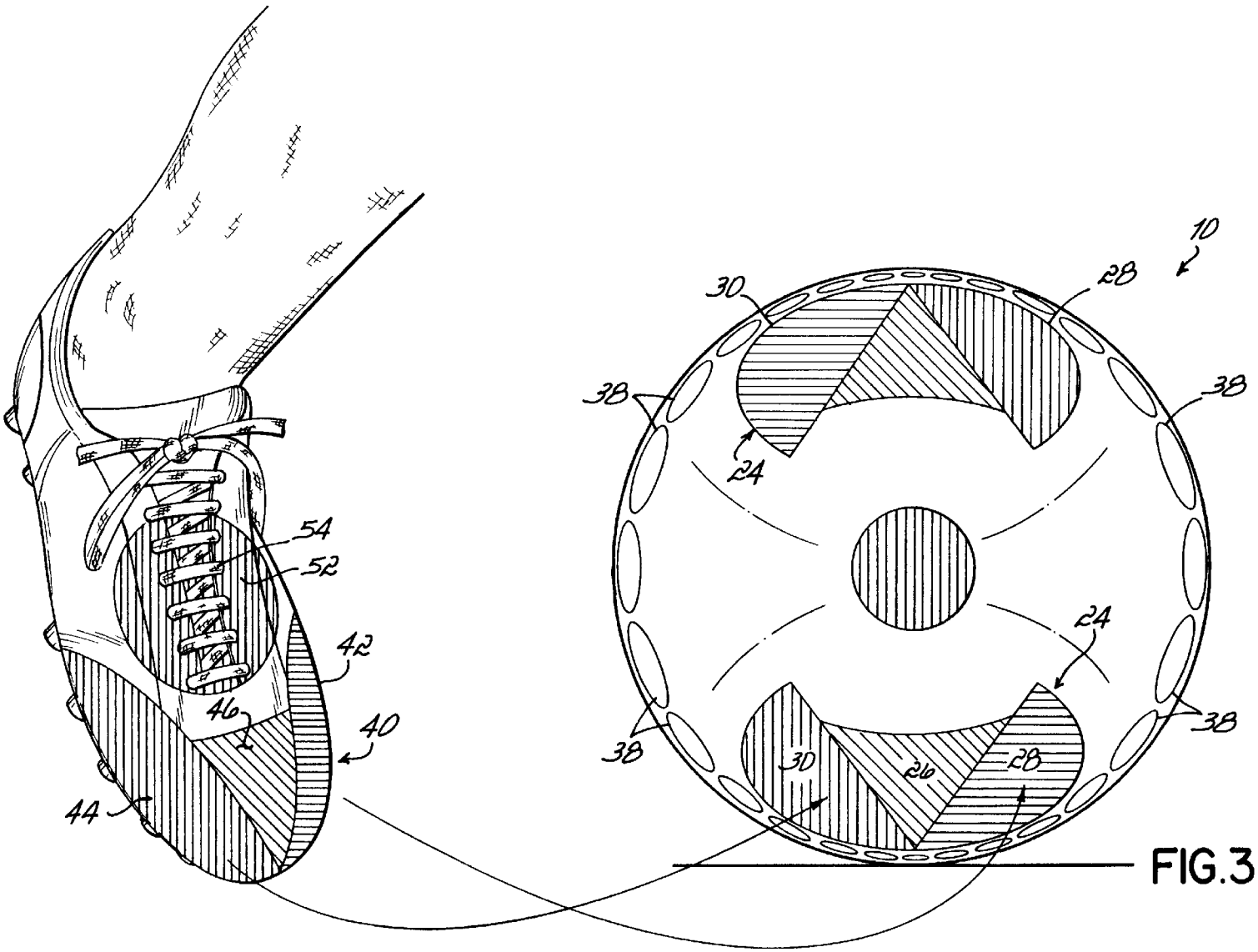
FIG. 3 is a perspective view illustrating a right footed shoe of the present invention and the ball in which arrows indicate which portions of the shoe are to contact which portions of the ball.
Figure 5:
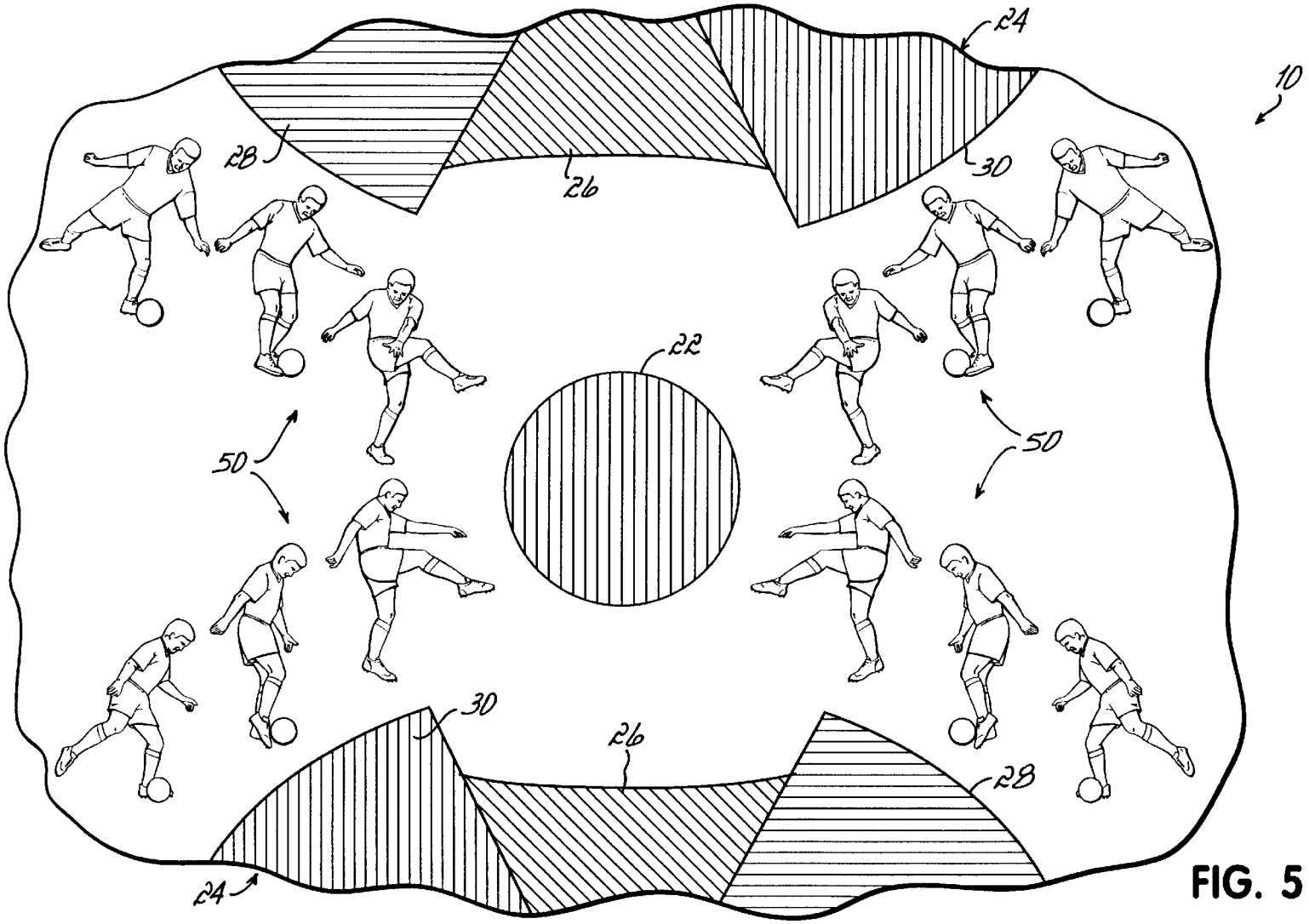
FIG. 5 is an enlarged developed view of a portion of the ball of FIGS. 1 and 2.

The dashed lines of FIGS. 1, 3 and 5 are not to be placed on the ball but are merely to illustrate the center line for the figures such as those illustrated in FIG. 5 which are placed in the areas beside the power kick circles.

SUMMARY AND DESCRIPTION OF THE INVENTION

The invention of this application which accomplishes these objectives comprises a combination of a soccer ball 10 and a pair of soccer shoes 12, a left shoe 13 and a right shoe 14 (see FIG. 4) which function as a training device. The soccer ball 10 has multiple differently shaped colored markings on the exterior thereof so as to illustrate to a user where to strike the ball in order to make the ball travel in preselected directions and at differing velocities. Likewise, each shoe has on the exterior thereof a plurality of colored markings so as to instruct the user of the shoes where on the shoe to kick the ball to make the ball travel at certain velocities and in preselected directions.

Referring first to the ball 10 of the present invention, the ball has two circular ground markings 16 on opposite sides of the ball 10 which indicate to the user to place this portion of the ball against the ground in order to properly orient the ball. The two ground markings 16 may be any color but are the same color; in the drawings the ground markings 16 are illustrated as being green. Outside of each ground marking 16 is located an inner ring 18 of a different color than the circular ground marking 16 and an outer ring 20 of a third color different than the color of the ground marking and the color of the inner ring 18. In our drawings, the inner ring 18 is illustrated as being red and the outer ring 20 as being blue. The rings 18, 20 are to distinguish the circular ground markings 16 from the power kick circles 22 to be described later.

Figure 2:
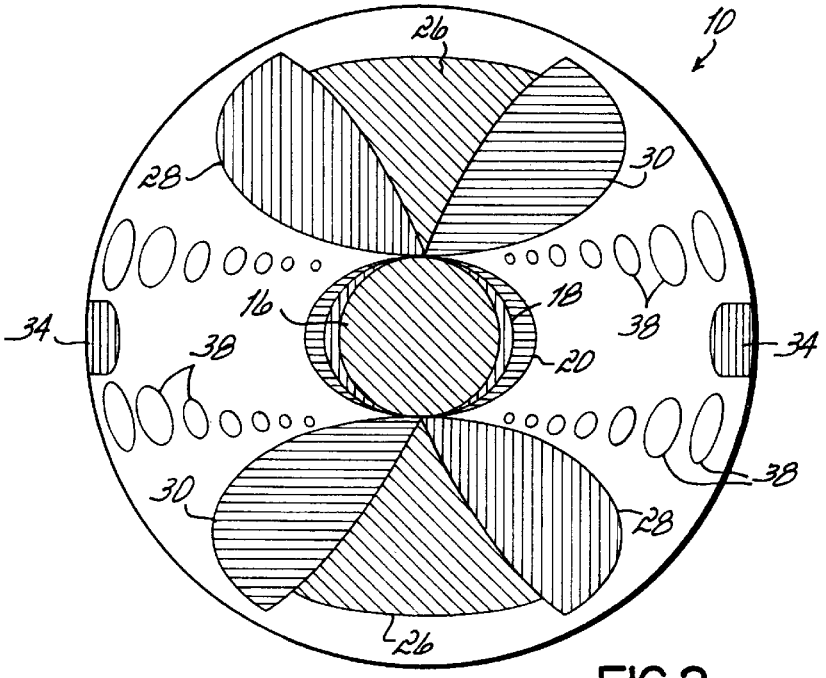
FIG. 2 is a perspective view illustrating a bottom portion of the soccer ball of FIG. 1.

The ball 10 further has four distinct areas in which it is marked, each marked area 24 comprising one triangular shaped center marking 26 and two additional side markings, a left side marking 28 and a right side marking 30 (see FIG. 2). The left side marking 28 is located to the left of the generally triangular shaped center marking 26 when the generally triangular shaped marking 26 is oriented such that one of the three points of the triangle is below the other two (see the triangular center marking 26 located above the ground marking 16 in FIG. 2). Likewise, the right side marking 30 is located to the right of the triangular center marking 26 when the generally triangular shaped marking 26 is oriented as described above. Each side marking 28, 30 is in the shape of half an ellipse. The generally triangular shaped center marking 26 is located between the two side markings 28, 30. The center generally triangular marking 26 is colored one color and the two side markings 28, 30 located on opposed sides of the triangular center marking 26 are of differing colors from each other and a different color than the color of the central triangular marking 26. Each of the four marked areas 24 of the ball is colored the same way with each of the four center generally triangular markings 26 being the same color, all four left side markings 28 being the same color and all four right side markings 30 being the same color. For example, the center generally triangular marking 26 of each of the four marked areas 24 is colored the same color, green in our example and each right side marking 30 located to the right of the triangular center marking is colored the same color, blue in our example. Likewise, the left side marking 28 located to the left of the center triangular marking 26 is colored the same color for each marked area, red in our example.

The ball 10 further includes two circular markings or power kick circles 22 located on opposed sides of the ball between two marked areas 24 (illustrated in FIGS. 1 and 3). These are areas on the ball which are to be hit with the instep of the user's shoe when the user wishes to drive the ball low and at a high velocity. These two power kick circles 22 are the same color, for example, red.

Additionally, two elliptical shaped markings 34 are located on the exterior of the ball on opposed sides of the ball. Each elliptical shaped marking 34 is 90° offset from the location of a power kick circle 22. These elliptical shaped markings 34 are on the ball to instruct a user how to make a low accurate kick. The user is instructed to kick either one of these two elliptical shaped markings 34 of the ball with the inner side surface of his or her foot in order to make a low, accurate pass. In order to instruct a child or beginner how to make a passing kick, the ball is oriented such that one of the power kick circles 22 is located against the ground at the bottom of the ball and one of the elliptical shaped markings 34 is facing the user. With the ball so oriented, the user is able to approach the ball easily and place his or her non-kicking foot beside the ball and strike the elliptical shaped marking 34 on the ball with an elliptical shaped marking 36 (see FIG. 4) on the inner side surface of his or her kicking shoe 12.

The exterior of the ball is further marked so as to include two series of small ball-like figures 38 (see FIGS. 1 and 2), the size of the ball-like figures 38 increasing as they move away from the circular ground markings 16 until they reach the elliptical shaped markings 34 on the ball. The ball-like figures 38 decrease in size as they move away from the elliptical shaped markings 34 on the ball and toward the circular ground markings 16. Each of these circles of ball-like figures 38 encircles two of the marked areas 24 and one of the power kick circles 32. Between the two circles of ball-like figures 38 is located each of the two elliptical shaped markings 34. These ball-like figures 38 are to illustrate to the user that by kicking one of the side markings 28, 30 of a marked area 24, he or she can kick the ball upward and curve the ball either in an inward or outward direction.

Referring to FIG. 5, the areas on the ball surrounding the power kick circles 22 may be decorated with a series of soccer player figures 50. One embodiment of these figures in shown in FIG. 5 and has twelve figures. Six figures are located slightly above the power kick circle and six figures below the power kick circle 22. The figures on the right side of the ball show a left footed kicker making the kicks and the figures on the left side of the power kick circle illustrate a right footed kicker making the kicks. The types and number of figures and specific kicks illustrated may vary without departing from the spirit of the invention. These figures are to aid in the instruction of youth or beginners as an illustration of the proper form to be used with the ball and shoes of the present invention.

Figure 4:
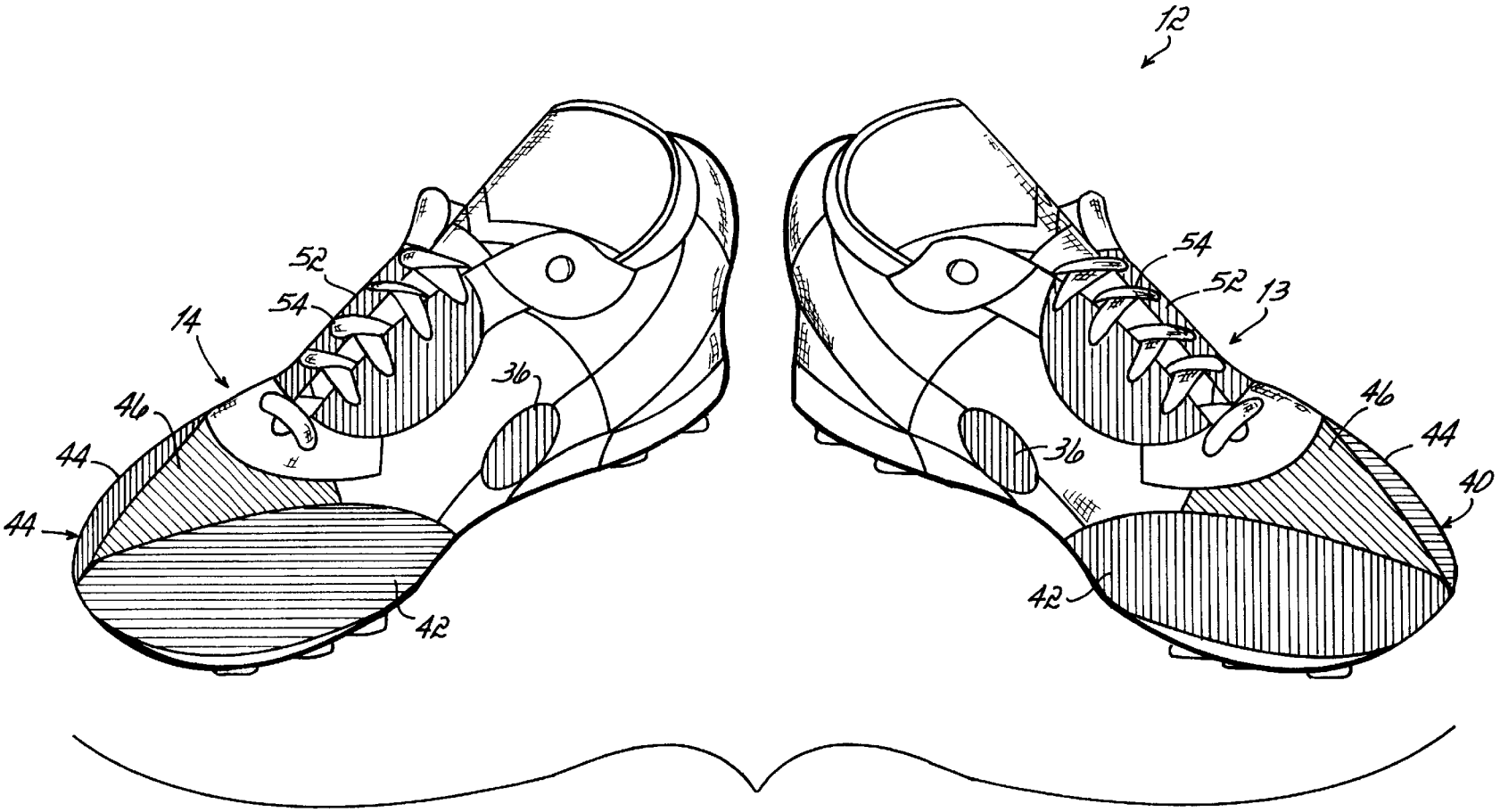
FIG. 4 is a perspective view of a pair of shoes of the present invention.

Regarding the shoes, each shoe 12 has several different markings on the exterior of the shoe. These markings are of several different colors corresponding to the colors of the marked areas on the ball. Referring to FIGS. 3 and 4, the toe portion 40 of each shoe 12 is divided into three areas; an inner surface area 42, a triangular shaped middle area 46 and an outer surface area 44. The middle surface areas 46 of both toe portions 40 of the left and right shoes of the present invention are identically colored, for example, green. The inner surface area 42 of the toe portion 40 of the right shoe 14 is colored a color different than the middle surface areas 46 of the toe portions 40 of the shoes, for example, blue. Lastly, the outer surface area 44 of the toe portion 40 of the right shoe 14 is colored a third color, different from the colors of the inner and middle areas of the toe portion of the right shoe 14, for example, red.

Referring to FIG. 4, the left shoe 13 is marked the same way as the right shoe 14 but with different colors used in the toe portions 40 of the shoes 12. The inner surface area 42 of the toe portion 40 of the left shoe 13 is colored the same color as the outer surface area 44 of the toe portion 40 of the right shoe 14, in our example, red. Likewise, the outer surface area 44 of the toe portion 40 of the left shoe 13 is colored the same color as the inner surface area 42 of the toe portion 40 of the right shoe 14, in our example, blue. The purpose behind this coloring scheme is so that one ball may be used to instruct a child or beginning soccer player to kick the ball both right footed and left footed.

Referring to FIG. 3, the color of the inner toe area 42 of the right shoe 14 corresponds to the color of the right side marking 30 of each of the four marked areas 24 of the ball. If one desires to curve a ball inwardly when one kicks the marked ball with the marked shoe, the inner surface area 42 of the toe portion 40 of the right shoe 14 contacts the right side marking 30 of the marked area 24 of the ball causing the ball to curve inwardly. The circular band of soccer ball-like figures 38 illustrated on the ball (see FIG. 2) indicates to the user that when he or she contacts the inner surface area 42 of the toe portion 40 of the right shoe 14 to a right side marking 30 the ball will curve from right to left, i.e. inwardly for a right footed kicker.

Similarly, the color of the inner toe area 42 of the left shoe 13 corresponds to the color of the left side marking 28 of each of the four marked areas 24 of the ball, in our example, red. The color of the outer surface area 44 of the toe portion 40 of the left shoe 13 corresponds to the color of the left side markings 30 of the four marked areas 24 of the ball, in our example, blue. If a left footed kicker contacts the inner surface area 42 of the toe portion 40 of the left shoe 13 to a left side marking 28, the ball will curve from left to right. This type of kick is known in the industry as a banana kick.

Likewise, the color of the middle area 46 of the toe portion 40 of each shoe 12 corresponds to the color of the triangular shaped middle portion 26 of each marked area 24 of the ball. This middle triangular portion 26 of each of the four marked areas 24 of the ball 10 is the same color as the color of the middle toe portion 46 of each shoe. When one desires to kick the ball straight and high, i.e. loft or chip the ball over an object, one contacts these identically colored areas together, for example, the green middle area 46 of the toe portion 40 of the shoe 12 contacts the green center marking 26 of a marked area 24 of the ball. The use of color aids a user such as a child in striking the correct portion of the shoe with the correct portion of the ball.

The outer surface area 44 of the toe portion 40 of each shoe 12 is colored a preselected color different than the colors of the other two areas of the toe portion 40 of the shoe 12. The color of the outer surface area 44 of the toe portion 40 of the right shoe 14 corresponds to the color of the left side markings 28 of the marked areas 24 of the ball, in our example, red. If one strikes the outer surface area 44 of the toe portion 40 of the right shoe 14 to a left side marking 28 on the ball, the ball will curve left to right or outwardly for a right footed kicker (see FIG. 3).

Likewise, the color of the outer surface area 44 of the toe portion 40 of the left shoe 13 (the same color of the inner surface area of the toe portion 40 of the right shoe 14) is the same color as the color of the right side markings 30 of the four marked areas 24 of the ball. When a user strikes the outer surface area 44 of the toe portion 40 of the left shoe 13 to a right side marking 30, the ball will curve from left to right or outwardly for a left footed kicker. This is also known as a banana kick.

In addition, each shoe 12 has on the inner side surface thereof an elliptical shaped marking 36 (see FIG. 4) colored the same color as the two elliptical markings 34 on the ball, for example, red. In order to make a low accurate kick such as a pass to a teammate, the user is to strike an elliptical shaped marking 34 on the ball with the elliptical shaped marking 36 on the inner side surface of the shoe.

Additionally, each shoe 12 has a colored instep circle 52 located directly below the shoe laces 54 of the shoe 12. The color of the two instep circles 52 are the same, the same color as the two power kick circles 22 on the ball, i.e. red in our example. When one desires to make a low driven power kick , i.e. a kick with high velocity, one contacts this area of the shoe, known in the industry as the instep to one of the two power kick circles 22 marked on the ball.

The pair of shoes 12 of the present invention are similarly marked and are colored as illustrated in FIG. 4. The colors of the toe portions of the left and right shoes are slightly different, the color of the outer surface area of the toe portion of one shoe being the same color as the inner surface area of the toe portion of the other shoe. The colors may be varied from those described above so as to be more feminine, for example, a girl's soccer shoe may employ colors such as pink, light blue and light green, while a boy's soccer shoe would employ colors such as dark blue, red, and dark green. The colors illustrated and used in the example are merely illustrative and may be varied.

Thus, the invention of the present application is a useful tool for teaching youth how to kick a soccer ball correctly in order to make the soccer ball travel in predetermined directions and at predetermined velocities. The use of color coding preselected marked areas on the ball and on the shoe is useful when teaching young children where to place the shoe on the ball. Thus, the application of the present invention is a useful tool for teaching children how to properly kick a soccer ball as well as adults or people who are not skilled in kicking a soccer ball correctly. After practicing with the present invention for a period of time, the user will become comfortable making the kicks described hereinabove.

The invention of the present application may be used on other balls such as footballs, softballs or baseballs. Therefore, I do not intend to be limited except by the following claims.

What is claimed is:

1. In combination, a soccer shoe and soccer ball, said combination comprising:

a ball having an exterior surface with selected marked areas on the exterior surface of said ball, the marked areas of the ball being of differing shapes;

at least one shoe having markings on the exterior thereof, said markings of said shoe being of differing shapes and corresponding to identical shapes marked on the ball such that when kicking the ball with the shoe, a marking on the shoe is to impact a corresponding marking on the ball so as to make the ball travel in a desired direction and at a desired speed.

2. The combination of claim 1 wherein said marked areas of said ball and said marked areas of said shoe are colored.

3. The combination of claim 1 wherein a marked area of said ball is colored a first color and a corresponding marked area of said shoe is colored said first color in order to instruct a user to strike the marked area of the ball with the marked area of the shoe.

4. A soccer training device comprising:

a ball having an exterior surface, said exterior surface being decorated with colored markings of differing colors and shapes, a pair of shoes, each shoe having an exterior surface, said exterior surface of said shoe being decorated with colored markings of differing colors and shapes, select markings on said exterior surface of said shoe corresponding in color and shape with select markings on said exterior surface of said ball so as to instruct a user how to kick the ball with the shoe and direct the ball a preselected direction.

5. The training device of claim 4 wherein the shapes of the markings on the ball are similar to the shapes of the markings on the exterior surface of the shoe.

6. The training device of claim 4 wherein each shoe of said pair of shoes is similarly marked.

7. A soccer teaching device comprising:

a soccer ball having an exterior surface having markings of differing shapes and differing colors on the exterior surface of the ball, a shoe having an exterior surface having a plurality of markings of differing colors and differing shapes on the exterior surface of the shoe, the markings on the shoe corresponding to markings of identical color on the ball in order to teach a person wearing the shoe to strike a preselected portion of the ball with a preselected portion of the shoe.

8. The teaching device of claim 7 wherein the ball has a marked area on the exterior surface of the ball where the ball is to be placed on the ground in order to properly position the differing markings of the ball.

* * * * *